US005566513A

United States Patent [19]

Herren

[11] Patent Number: 5,566,513

[45] Date of Patent: Oct. 22, 1996

[54] GUTTER GUARD APPARATUS

[76] Inventor: John T. Herren, 1001 River Rd., Farmville, Va. 23901

[21] Appl. No.: 466,177

[22] Filed: Jun. 6, 1995

[51] Int. Cl.[6] ..... E04D 13/064

[52] U.S. Cl. ..... 52/12; 52/11; 24/336; 210/474; 248/48.1

[58] Field of Search ..... 52/12, 11, 16; 24/336, 339; 210/163, 164, 473, 474; 248/48.1, 48.2

[56] References Cited

U.S. PATENT DOCUMENTS

| | | | |
|---|---|---|---|
| 2,810,173 | 10/1957 | Bearden | 210/474 X |
| 3,351,206 | 11/1967 | Wennerstrom | 52/12 X |
| 3,965,540 | 6/1976 | Moore | 24/336 X |
| 4,170,181 | 10/1979 | Glasgow | 24/336 X |
| 4,553,356 | 11/1985 | Pepper | 52/12 X |
| 4,745,710 | 5/1988 | Davis | 52/12 |
| 4,750,300 | 6/1988 | Winger, Jr. | 52/12 |
| 4,856,237 | 8/1989 | Wigle | 52/12 |
| 4,993,126 | 2/1991 | Collins | 24/336 |
| 5,095,666 | 3/1992 | Williams, Jr. | 52/12 X |

FOREIGN PATENT DOCUMENTS

| | | | |
|---|---|---|---|
| 267697 | 6/1964 | Australia | 52/12 |

*Primary Examiner*—Wynn E. Wood
*Assistant Examiner*—Kevin D. Wilkens
*Attorney, Agent, or Firm*—Henderson & Sturm

[57] ABSTRACT

A gutter guard apparatus (10) comprising a one-piece guard member (20) fabricated from sheet metal material (21) and provided with a capture portion (22) which captively secures one end (33) of a sheet (30) of screening material (31), and is further provided with a flange element (23) having a plurality of clip elements (24) which cooperate with one another to releasably engage the outer lip (101) of a gutter trough (100); wherein, the free end (32) of the sheet (30) of screening material (31) is disposed intermediate the first (201) and second (202) rows of shingles on a shingled roof (200).

9 Claims, 2 Drawing Sheets

GUTTER GUARD APPARATUS

TECHNICAL FIELD

The present invention relates to the field of gutter screen assemblies in general, and in particular to a gutter guard apparatus employing a new type of screen capturing and gutter engaging dip unit.

BACKGROUND ART

As can be seen by reference to the following U.S. Pat. Nos. 2,734,567; 2,805,632; 2,948,083; and 4,841,686; the prior an is replete with myriad and diverse gutter screen assemblies.

While all of the aforementioned prior art constructions are more than adequate for the basic purpose and function for which they have been specifically designed, these patented structures are deficient either from the stand point of either the simplicity or complexity of their respective constructions.

In the instance of the simpler constructions, they are normally characterized by a flimsiness and fragility that does not provide sufficient rigidity to the screening element to guarantee a long useful life; whereas, in the instance of the more complex structures, they are much more difficult to manufacture and therefore more expensive bringing into effect the cost versus benefit ratio for the consumer.

As a consequence of the foregoing situation, there has existed a longstanding need among consumers for a simple, rugged, and inexpensive gutter guard apparatus that incorporates structural innovations and improvements that are not found in the prior art constructions, and the provision of such a construction is a stated objective of the present invention.

DISCLOSURE OF THE INVENTION

Briefly stated, the gutter guard apparatus that forms the basis of the present invention comprises a screen unit and a guard unit; wherein, the guard unit has one portion which captively engages one end of the screen unit and has another potion which releasably engages the outer lip of the gutter trough.

As will be explained in greater detail further on in the specification, the gutter guard apparatus of this invention employs a one-piece guard unit that is rugged in construction yet relatively simple and inexpensive to manufacture while still providing more than adequate support and rigidity to the assembled gutter guard apparatus.

In addition, the guard unit is further provided with a dam portion that reverses the flow of water that impacts the dam portion so that the water is prevented from flowing over the lip of the gutter and the flow is diverted back onto and through the screen unit into the gutter trough.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
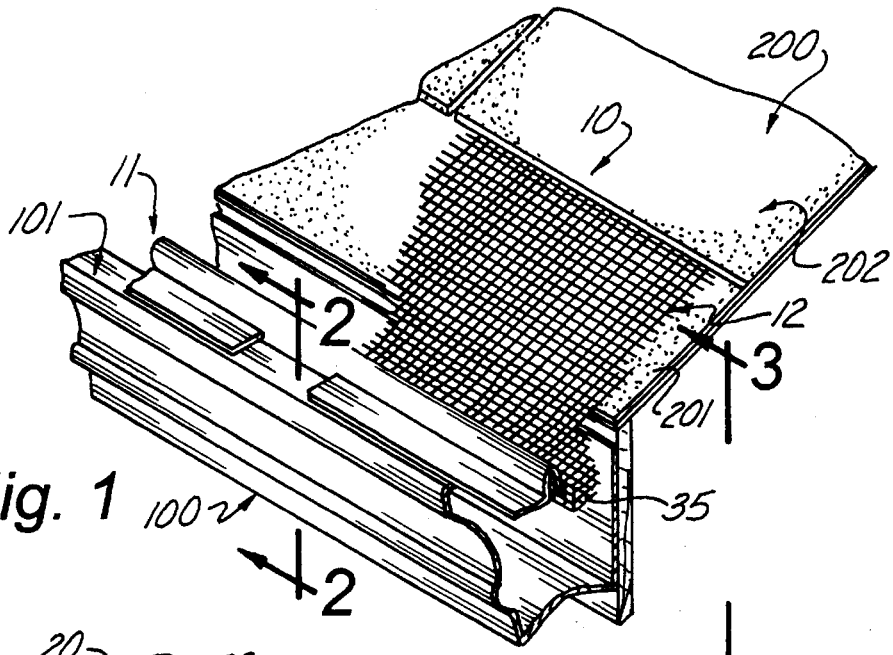
FIG. 1 is a perspective view of the gutter guard apparatus that forms the basis of the present invention installed in its intended environment.
Figure 2:
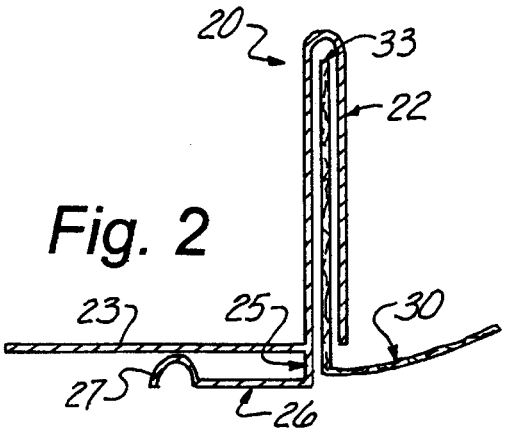
FIG. 2 is a cross-sectional view taken through line 2—2 of FIG. 1.

As can be seen by reference to the drawings, and in particular to FIG. 1, the gutter guard apparatus that forms the basis of the present invention is designated generally by the reference numeral (10). The apparatus (10) comprises in general: a guard unit (11) and a screen unit (12) that will now be described in seriatim fashion.

As shown in FIGS. 2 and 5 through 7, the guard unit (11) comprises an elongated contoured sheet metal member (20) preferably fabricated from aluminum stock sheet (21) and including a first inverted u-shaped narrow capture means or portion (22) having a flange element (23) projecting outwardly from the outboard lower end of the capture portion (22).

In addition, selected spaced segments of the flange element (23) are severed and contoured to provided a plurality of clip elements (24) whose purpose and function will be described presently. Each of the clip elements (24) further comprise a downwardly depending leg (25) having an outwardly projecting leg (26) which terminates in a curved lip (27); wherein, all of the structural components of the guard member (20) are formed integrally with one another from an elongated strip of sheet metal.

Figure 4:
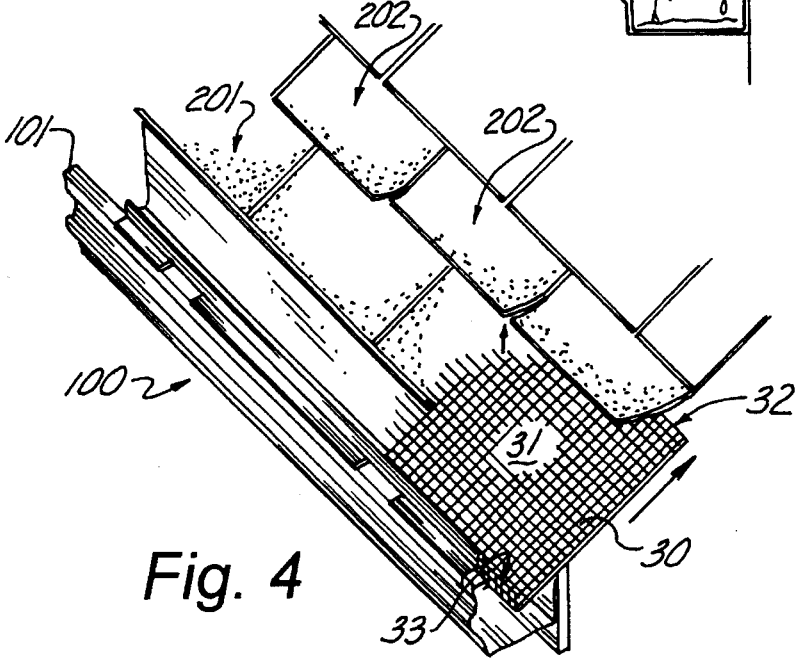
FIG. 4 is a perspective view illustrating the engagement of the free end of the screen unit with the roofing shingles.
Figure 5:
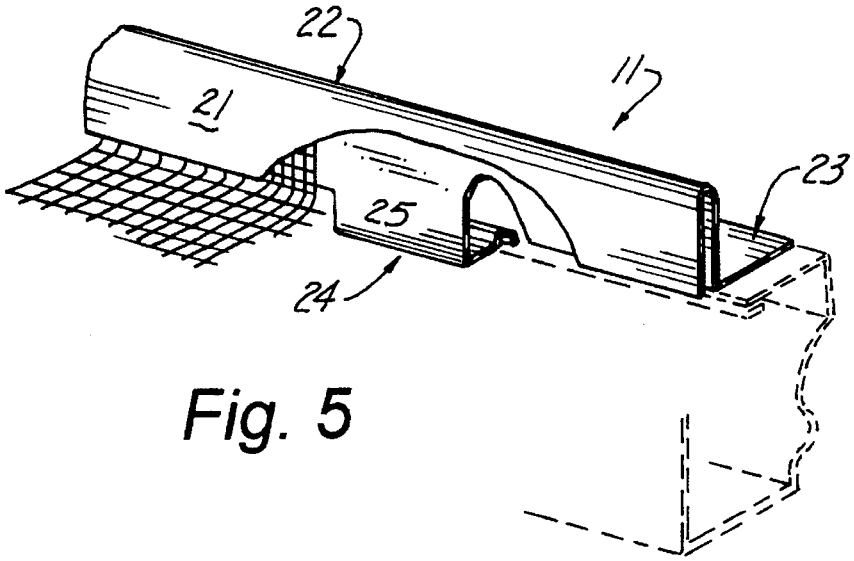
FIG. 5 is a rear cut-away perspective view of the engagement of the guard unit with the lip of the gutter trough.
Figure 6:
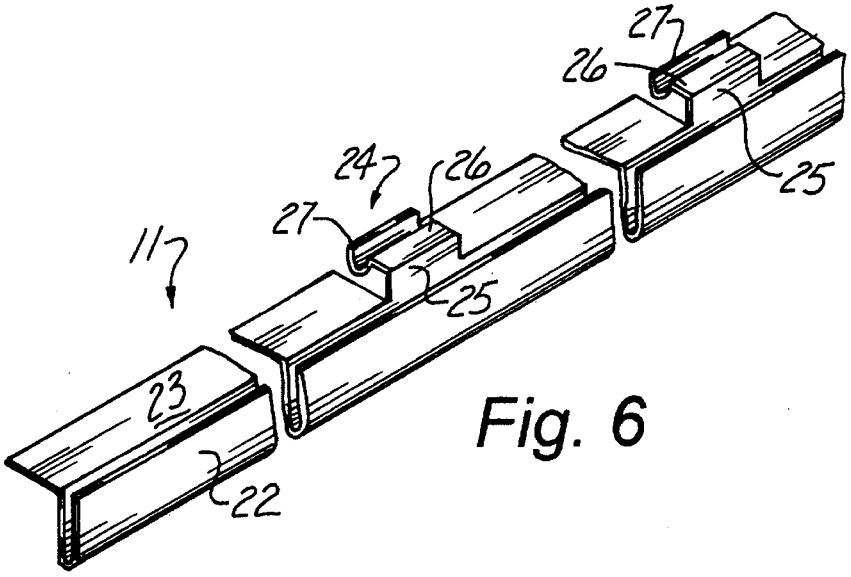
FIG. 6 is a bottom perspective view of the guard unit.
Figure 7:
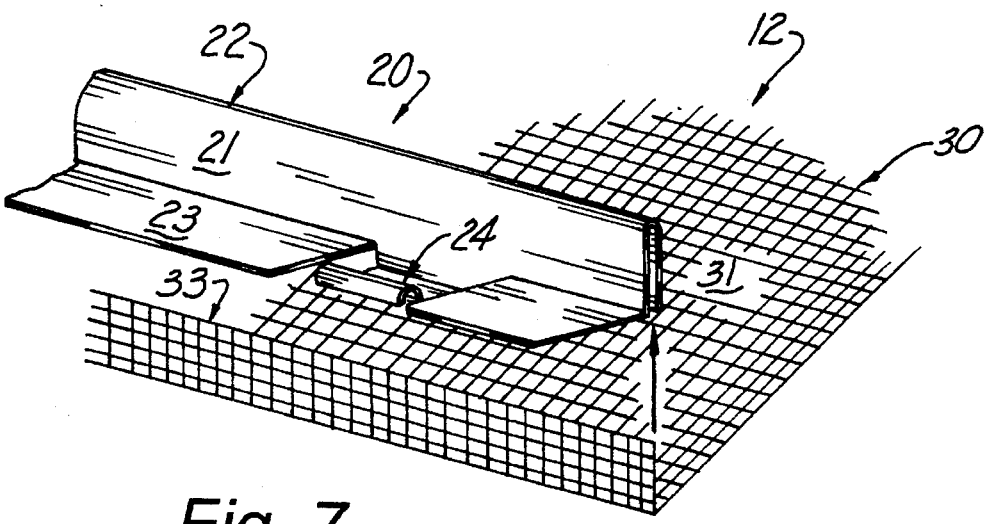
FIG. 7 is a exploded perspective view showing the operative engagement between the guard unit and one end of the screen unit.

Turning now to FIGS. 4 and 7, it can be seen that the screen unit (12) comprises a generally flat rectangular sheet (30) of screening material (31) having a generally flat free end (32) and a vertically disposed captive end (33) which is dimensioned to be received in the capture portion (22) of the guard member (20); wherein, the u-shaped capture portion (22) is designed to be crimped or otherwise disposed in a fixedly secure manner relative to the captive end (33) of the sheet (30) of screening material.

Figure 3:
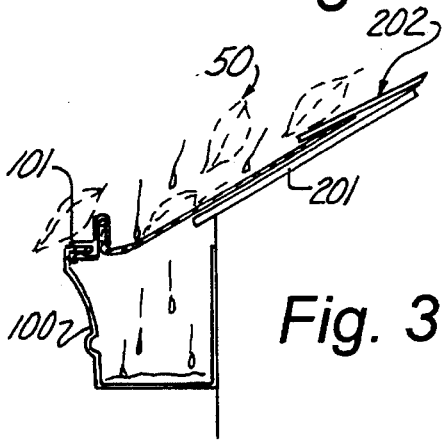
FIG. 3 is a cross-sectional view taken through line 3—3 of FIG. 1.

As can best be seen by reference to FIGS. 1, 3 and 4, once the screen unit (12) has been operatively assembled to the guard unit (11) to form the gutter guard assembly (10), the assembly is ready to be installed between the outboard lip (101) of a rain gutter (100) and a row of shingles (202) on a shingled roof (200).

To begin with, the free end (32) of the sheet (30) of screening material (31) is inserted between the first row (201) of shingles and the second (202) row of shingles, and then the curved ends (27) of the clip elements (24) on the guard member (20) engage the underside of the gutter lip (101) while the flange element (23) engages the top of the gutter lip (101) in a well-recognized fashion.

At this juncture, it should be noted that the capture portion (22) of the guard member (20) also serves as a raised dam element that will prevent water from flowing over the outer edge of the gutter trough (100) even when the screen material (31) becomes clogged with debris such as leaves or the like. As shown in FIG. 3, water cascading down the roof line and over accumulated debris (50) will have the direction of flow reversed by the raised capture portion (22) of the guard member (20) such that the water will be redirected onto and through the screen material (31) to be deposited inside the confines of the gutter trough (101).

It should also be noted that by virtue of choosing aluminum sheet stock (21) for the guard unit (11) and fabricating the screen unit (12) from commercially available plastic or stainless steel screening material or hardware cloth, the useful life of the gutter guard apparatus (10) is essentially indefinite.

As can also be seen by reference to FIG. 1, one edge (35) of the screen unit (12) extends beyond the clip unit (11) such that adjacent sections of the apparatus (10) can overlap one another in their assembled disposition.

Furthermore, the apparatus (10) can be installed without the benefit of special tools and can be removed or replaced just as easily.

Having thereby described the subject matter of the present invention, it should be apparent that many substitutions, modifications and variations of the invention are possible in light of the above teachings. It is therefore to be understood that the invention as taught and described herein is only to be limited to the extent of the breadth and scope of the appended claims.

I claim:

1. A gutter guard apparatus for use between the outer lip of a conventional gutter trough and the first and second rows of shingles on a shingled roof, wherein the gutter guard apparatus comprises:

a screen member, including a generally flat rectangular sheet of screening material having a first generally flat free end and a second generally vertically disposed captive end, and a guard unit comprising an elongated contoured guard member having first means for captively engaging the vertically disposed captive end of said screening material and a plurality of spaced clip elements for releasably engaging the outer lip of said conventional gutter trough wherein said first means forms a raised vertical dam to redirect the flow of rain water from said roof into said gutter trough.

2. The apparatus as in claim 1; wherein, said guard member is further provided with a flange element which projects outwardly from said first means.

3. The apparatus as in claim 2; wherein said clip elements are formed from spaced severed segments of said flange element.

4. The apparatus as in claim 1; wherein said guard member is fabricated from sheet metal.

5. The apparatus as in claim 4; wherein said sheet metal comprises aluminum sheet stock.

6. The apparatus as in claim 1; wherein said first means comprises an inverted u-shaped capture portion of the guard member which is dimensioned to receive said vertically disposed captive end of said screening material.

7. The apparatus as in claim 6; wherein said capture portion is fixedly secured relative to the captive end of said screening material.

8. The apparatus as in claim 7; wherein said capture portion is crimped into a secured relationship relative to the captive end of said screening material.

9. A gutter guard apparatus for use between the outer lip of a conventional gutter trough and the first and second rows of shingles on a shingled roof, wherein the gutter guard comprises:

a guard unit fabricated from a contoured strip of material and including a generally inverted u-shaped capture portion having a flange element projecting outwardly from one side and provided with a plurality of spaced clip elements which cooperate with said flange element to releasably engage the outer lip of said conventional gutter trough; and a generally rectangular sheet of screening material having one end captively engaged in the capture portion of said guard member; wherein said capture portion of the guard member forms a raised vertical dam to redirect the flow of rain water from said roof into said gutter trough.

* * * * *